United States Patent [19]

Lu

[11] 4,391,890

[45] * Jul. 5, 1983

[54] DEVELOPER COMPOSITIONS CONTAINING ALKYL PYRIDINIUM TOLUENE SULFONATES

[75] Inventor: Chin H. Lu, Webster, N.Y.

[73] Assignee: Xerox Corporation, Stamford, Conn.

[ * ] Notice: The portion of the term of this patent subsequent to Nov. 3, 1998, has been disclaimed.

[21] Appl. No.: 327,294

[22] Filed: Dec. 3, 1981

[51] Int. Cl.[3] ..... G03G 9/10

[52] U.S. Cl. ..... 430/110; 430/120

[58] Field of Search ..... 430/106, 109, 110, 115, 430/120, 121, 122, 123

[56] References Cited

U.S. PATENT DOCUMENTS

| | | | |
|---|---|---|---|
| 3,893,935 | 7/1975 | Jadwin et al. . | |
| 3,944,493 | 3/1976 | Jadwin et al. . | |
| 3,970,571 | 7/1976 | Olson et al. . | |
| 3,985,664 | 10/1976 | Sakaguchi et al. . | |
| 4,079,014 | 3/1978 | Burness et al. . | |
| 4,221,856 | 9/1980 | Lu | 430/110 |
| 4,298,672 | 11/1981 | Lu | 430/108 |

FOREIGN PATENT DOCUMENTS

| | | |
|---|---|---|
| 1181287 | 2/1970 | United Kingdom . |
| 1536514 | 12/1978 | United Kingdom . |

*Primary Examiner*—Roland E. Martin, Jr.
*Attorney, Agent, or Firm*—E. O. Palazzo

[57] ABSTRACT

This invention is directed to developer compositions comprised of toner particles and carrier particles, the toner particles being comprised of resin particles, pigment particles, and from about 0.1 to about 10 percent based on the weight of the toner particles of an alkyl pyridinium toluene sulfonate charge enhancing additive of the formula:

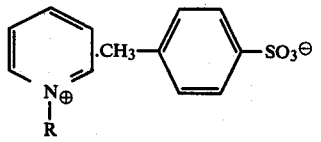

wherein R is an alkyl radical containing from about 12 carbon atoms to about 25 carbon atoms, which compositions are useful for causing the development of images in electrostatographic imaging systems.

20 Claims, No Drawings

DEVELOPER COMPOSITIONS CONTAINING ALKYL PYRIDINIUM TOLUENE SULFONATES

BACKGROUND OF THE INVENTION

This invention is generally directed to toner compositions and developer materials containing such compositions, as well as the use of these materials in electrostatographic imaging systems, particularly those systems wherein the photoresponsive device has been charged negatively. More specifically, the present invention is directed to developing compositions wherein the toner component is charged positively by certain charge control additives, which toner compositions having improved particle to particle uniformity, fast admix charging, narrow charge distributions, improved humidity stability, improved thermal stability, improved resin dispersibility, and improved carbon black dispersion.

The utilization of charge enhancing additives are known in the prior art, these additives being used primarily for the purpose of imparting a positive charge to the toner composition. There is described for example in U.S. Ser. No. 911,623, filed on June 1, 1978, in the name of C. H. Lu, developing compositions comprised of toner particles, carrier particles and as a charge control additive an alkyl pyridinium halide, such as cetyl pyridinium chloride. Also there is disclosed in U.S. Pat. No. 3,893,935 the use of certain quaternary ammonium compounds as charge control agents for electrostatic toner compositions. According to the disclosure of this patent certain specific quaternary ammonium compounds when incorporated into toner compositions were found to provide a toner which exhibited relatively high uniform and stable net toner charge when mixed with a suitable coated carrier coating. U.S. Pat. No. 4,079,014 contains a similar teaching with the exception that a different charge control agent is utilized, namely a diazo type material.

While some of the above developing compositions are suitable for certain purposes, their incompatibility with the toner resin causes difficulties in obtaining uniform dispersions of such materials in the toner formulation comprised of toner resins and carbon black. Further, some of the prior art charge enhancing additives when incorporated into toner compositions migrate to the toner surface at high relative humidity, causing the electrical properties of the resulting developer composition to be adversely affected. Also as it is very difficult to uniformly disperse or dissolve many of the prior art charge enhancing additives, in toner compositions, there results particle to particle non-uniformity, and in some instances an undesirable wide distribution of electrical charge which is not desired.

There continues to be a need for developing compositions which can be used in imaging systems wherein the photoresponsive member is charged negatively, and more specifically, there continues to be a need for improved toner compositions which are positively charged and contain therein charge enhancing additives which are not only soluble in organic materials, but are also humidity insensitive. Additionally there continues to be a need for toner compositions which will rapidly charge new uncharged toner particles being added to a developing composition comprised of charged toner particles and carrier particles, and wherein the charge enhancing additive employed is compatible with the toner resin. Further, there is a need for positively charged toner compositions which do not decompose at high temperatures, thus enabling such compositions to be subjected to a fusing operation.

SUMMARY OF THE INVENTION

It is an object of the present invention to provide a developer composition which overcomes the above-noted disadvantages.

In another object of the present invention there is provided a developer composition which contains positively charged toner particles and carrier particles.

It is another object of the present invention to provide positively charged toner particles containing certain charge enhancing additives, which additives are soluble in organic materials, humidity insensitive, have improved admix charging, and excellent thermal stability.

In an additional aspect of the present invention there is provided toner compositions useful for the development of negative electrostatic images, which compositions will transfer effectively electrostatically to plain bond paper without causing blurring, or adversely affecting the quality of the resulting image.

These and other objects of the present invention are accomplished by providing dry electrostatic developing compositions containing resin particles, pigment particles, carrier particles, and an organic alkyl pyridinium toluene sulfonate charge enhancing additive of the following formula:

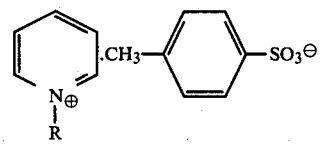

wherein R is an alkyl radical containing from about 12 carbon atoms to about 25 carbon atoms, and preferably from about 14 carbon atoms to about 20 carbon atoms.

Illustrative examples of alkyl radicals included within the scope of the present invention include tetradecyl, dodecyl, pentadecyl, cetyl, olely, heptadecyl, stearyl, pentacocyl, and the like. Preferred alkyl groups for R include tetradecyl, cetyl, and stearyl.

Illustrative examples of specific organic sulfonate charge enhancing additives included within the scope of the present invention include cetyl pyridinium para-toluene sulfonate, stearyl pyridinium para-toluene sulfonate, myristyl pyridinium para-toluene sulfonate, and the like.

By developer composition in accordance with the context of the present invention is meant compositions comprised of toner particles and carrier particles, the toner particles containing a toner resin, and a colorant or pigment.

The toner composition of the present invention contains therein the organic sulfonate charge enhancing additive in various amounts, providing that the properties of the toner composition are not adversely affected, and the toner particles are charged positively to an appropriate charge level in comparison to the carrier particles. Generally, the organic sulfonate charge enhancing additive is present in an amount of from about 0.1 percent by weight to 10 percent by weight of toner particles, and preferably from about 0.5 weight percent to about 5 weight percent of the total toner weight. In one preferred embodiment of the present invention, the organic sulfonate charge enhancing additive is present in an amount of from about 0.75 weight percent to about 3.0 weight percent. The sulfonate charge enhancing additive can either be blended in the toner particles or alternatively may be coated on the pigment surface, or on the toner particle surface. When the sulfonate is employed as a coating, it is generally present in an amount of from about 2 weight percent to about 20 weight percent, and preferably from about 5 weight percent to about 10 weight percent based on the weight of the pigment.

Numerous different methods may be utilized for preparing the toner composition of the present invention including for example melt blending the resin and the pigment coated with the organic sulfonate charge enhancing additive followed by mechanical attrition. Other known methods include for example spray drying, melt dispersion, dispersion polymerization, and emulsion polymerization. In dispersion polymerization a solvent dispersion of resin particles, pigment particles and the organic sulfonate charge enhancing additive of the present invention are spray dryed under control conditions resulting in the desired product. A toner composition prepared in this manner results in a positively charged toner in relationship to the carrier materials, and these compositions exhibit the improved properties as mentioned hereinbefore.

As the toner resin there can be utilized various suitable resins known in the art, illustrative examples of which include polyamides, epoxies, polyurethanes, vinyl resins, and polyesters, especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be a homopolymer of styrene, or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention. These materials are illustrated in U.S. Pat. No. 3,655,374, the disclosure of which is totally incorporated herein by reference, the diphenol reactant being of the formula as shown in column 4, beginning at line 5 of this patent, and the dicarboxylic acid being of the formula as shown in column 6 of the above patent.

The amount of toner resin present depends primarily on the percentage by weight of the organic charge enhancing sulfonate compound that is present and the percentage by weight of pigment or colorant such as carbon black. Thus, for example, when 5 percent by weight of the charge enhancing sulfonate compound is present, and 5 percent by weight of the pigment or colorant such as carbon black is present about 90 percent by weight of resin material is present.

Any suitable pigment or dye may be employed as the colorant for the toner particles, such materials being well known and including for example, carbon black, magnetite, iron oxides, nigrosine dyes, chrome yellow, ultramarine blue, DuPont oil red, methylene blue chloride, phthalocyanine blue and mixtures thereof. The pigment or dye should be present in the toner in sufficient quantity to render it highly colored, so that it will form a clearly visible image on the recording member. For example, where conventional xerographic copies of documents are desired, the toner may comprise a black pigment, such as carbon black, or a black dye such as Amaplast black dye available from the National Aniline Products, Inc. Preferably, the pigment is employed in amounts of from about 3 percent to about 50 percent by weight based on the total weight of toner, however, if the pigment employed is a dye, substantially smaller amounts, for example less than 10 percent by weight, may be used.

Illustrative examples of carrier materials that can be employed in formulating the developing compositions of the present invention, (toner plus carrier) include various known carriers, providing such carrier particles are capable of triboelectrically obtaining a charge of opposite polarity to that of the toner particles. In the present invention in one embodiment that would be a negative polarity, so that the toner particles will adhere to and surround the carrier particles. Thus, the carriers which are selected so that the toner particles acquire a charge of a positive polarity, include materials such as ammonium chloride, aluminum nitrate, potassium chlorate, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described for example in U.S. Pat. Nos. 2,618,441; 2,638,522; 3,591,503; and 3,533,835. Also nickel berry carriers as described in U.S. Pat. Nos. 3,847,604 and 3,767,598 can be employed, these carriers being nodular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner composition in any suitable combination, however, best results are obtained when about 1 part by weight to 3 parts by weight of toner is used, to about 10 to about 200 parts by weight of carrier.

Toner compositions of the present invention may be used to develop electrostatic latent images on most suitable electrostatic surfaces capable of retaining charge, including conventional photoconductors, however, the toners of the present invention are best utilized in systems wherein a negative charge resides on the photoreceptor, and this usually occurs with organic photoreceptors. Illustrative examples of such photoreceptors are polyvinyl carbazole, 4-dimethylaminobenzylidene, benzhydrazide; 2-benzylidene-amino-carbazole, 4-dimethylaminobenzylidene, benzhydrazide; 2-benzylidene-aminocarbazole, polyvinylcarbazole; (2-nitro-benzylidene)p-bromoaniline; 2,4-dimethyl-amino phenyl)-benzoxazole; 3-aminocarbazole; polyvinylcarbazole-trinitrofluorenene charge transfer complex; phthalocyanines, layered photoresponsive devices comprised of charge generating layers, and charge transport layers deposited on a substrate, and the like. Examples of charge generating layers include vanadyl phthalocyanine and trigonal selenium, while examples of transport layers include certain diamines dispersed in a binder. The type of layered photoresponsive devices that can be employed are described in U.S. Pat. Nos. 4,265,990, and 4,251,612, the disclosure of each of these patents being totally incorporated herein by reference.

Accordingly, the present invention in another embodiment is directed to a method of imaging comprising forming a negative electrostatic latent image on an imaging member, contacting the image with a positively charged electrostatic developing composition comprised of toner particles and carrier particles, the toner being comprised of resin particles, pigment particles, and from about 0.1 percent to about 10 weight percent, based on the weight of the toner particles of alkyl pyridinium toluene sulfonate charge enhancing additive of the formula:

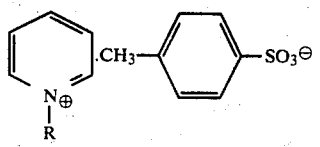

wherein R is an alkyl radical containing from about 12 carbon atoms to about 25 carbon atoms, followed by transferring the developed image to a substrate, and affixing the image thereto.

The following examples further define the species of the present invention, it being noted that these examples are intended to illustrate and not limit the scope of the present invention. Parts and percentages are by weight unless otherwise indicated.

EXAMPLE I

The charge control additive cetyl pyridinium para-toluene sulfonate of the following structure was synthesized by Hexcel Company, Lodi, New Jersey:

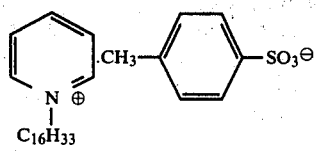

The isolated compound had a melting point of 133° C. to 135° C., a decomposition temperature of 220° C., and a solubility in water of less than 0.4 percent by weight. Moisture absorption measurements were accomplished on this material with the following results:

| Relative Humidity, Percentage | Moisture Content, Percentage |
|---|---|
| 20 | 0.05 |
| 51 | 0.05 |
| 81 | 0.09 |

A toner composition comprised of 2 percent of the above synthesized cetyl pyridinium para-toluene sulfonate, 6 percent of Regal 330 carbon black, and 92 percent of a styrene/n-butylmethacrylate copolymer, containing 65 percent by weight of styrene, and 35 percent by weight of n-butylmethacrylate was prepared by melt blending following by mechanical attrition. The resulting toner was classified in order to remove particles smaller than 5 microns in diameter.

The triboelectric charge on the resulting toner composition was measured against a Hoeganese steel carrier coated with a 0.15 percent Kynar 301, a vinylidene fluoride resin commercially available from Penwalt Corporation, at 3 percent toner concentration, with the following results:

| Time | Toner Tribo, Microcoulombs per gram (μc/g) |
|---|---|
| 10 min. | +47 |
| 1 hr. | +37 |
| 4 hr. | +24 |
| 24 hr. | +13 |

Charge distribution measurements revealed that the above developer composition had a narrow charge distribution with a minimum insignificant number of particles, less than 1 percent of toner particles, having a low charge, that is, a charge of about +2. Admix measurements utilizing a charge spectrograph revealed that the toner composition had fast charging properties when fresh uncharged toner particles were added to the charged developer composition, that is, the fresh uncharged toner particles became positively charged in less than 1 minute.

The above developer composition was utilized in a xeroraphic imaging device containing a negatively charged layered photoresponsive device containing an aluminum substrate, a generating layer of vanadyl phthalocyanine, and a transport layer of N,N'-diphenyl-N,N'-bis(3-methylphenyl)-[1,1'-biphenyl]-4,4'-diamine dispersed in Makrolon polycarbonate resin commercially available from Mobay Chemical Company, which device was prepared as described in U.S. Pat. No. 4,265,990, and excellent high quality images were obtained with high solid area density, and low background.

EXAMPLE II

A toner and developer composition was prepared in accordance with Example I with the exception that there was employed a styrene/n-butylmethacrylate copolymer resin comprised of 58 percent by weight of styrene, and 42 percent by weight of n-butylmethacrylate.

The triboelectric charge on the toner was measured in accordance with Example I, and with the same carrier material resulting in the following:

| Toner | Toner Tribo, Microcoulombs Per Gram (μc/g) |
|---|---|
| 10 min. | +49 |
| 1 hr. | +41 |
| 4 hr. | +28 |
| 24 hr. | +15 |

The above developer composition was employed to develop images in the xerographic imaging device of Example I, and substantially similar results were obtained.

EXAMPLE III

A toner composition comprised of 1 percent by weight of the cetyl pyridinium para-toluene sulfonate of Example I, 6 percent by weight of Regal 330 carbon black, and 93 percent by weight of a styrene/butadiene copolymer containing 91 percent by weight of styrene, and 9 percent by weight of butadiene, was prepared by melt blending followed by mechanical attrition. The toner was classified in order to remove particles smaller than 5 microns in diameter. The triboelectric charge on the toner was then measured in accordance with Example I, utilizing the same carrier material with the following results:

| Time | Toner Tribo, Microcoulombs Per Gram (μc/g) |
|---|---|
| 10 min. | +39 |
| 1 hr. | +37 |
| 4 hr. | +22 |
| 24 hr. | +10 |

The above developing composition was employed in the xerographic imaging device of Example I, and excellent high quality images of high resolution, low background and high solid area were obtained after 50,000 imaging cycles.

Other modifications of the invention may occur to those skilled in the art based upon a reading of the present disclosure, and these are intended to be included within the scope of the present invention.

What is claimed is:

1. An electrostatic developer composition comprised of toner particles and carrier particles, the toner particles being comprised of resin particles, pigment particles, and from about 0.1 to about 10 percent based on the weight of the toner particles of an alkyl pyridinium toluene sulfonate charge enhancing additive of the formula:

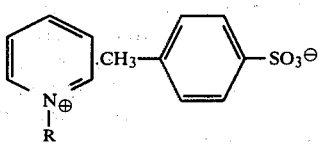

wherein R is an alkyl radical containing from about 12 carbon atoms to about 25 carbon atoms.

2. A developer composition in accordance with claim 1 wherein R is an alkyl radical containing from about 14 carbon atoms to about 20 carbon atoms.

3. A developer composition in accordance with claim 1 wherein R is cetyl.

4. A developer composition in accordance with claim 1 wherein the toner resin is a styrene/n-butylmethacrylate copolymer or a styrene/butadiene copolymer, and the pigment is carbon black.

5. A developer composition in accordance with claim 4 wherein the styrene/n-butylmethacrylate is comprised of 65 percent by weight of styrene, and of 35 percent by weight of n-butylmethacrylate.

6. A developer composition in accordance with claim 4 wherein the styrene/butadiene copolymer is comprised of styrene in an amount of 91 percent by weight, and butadiene in an amount of 9 percent by weight.

7. A developer composition in accordance with claim 1 wherein the charge enhancing additive is cetyl pyridinium para-toluene sulfonate.

8. A developer composition in accordance with claim 1 wherein the charge enhancing additive is stearyl pyridinium para-toluene sulfonate.

9. A developer composition in accordance with claim 1 wherein the charge enhancing additive is myristyl pyridinium para-toluene sulfonate.

10. A developer composition in accordance with claim 1 wherein the carrier consists of a steel core coated with a vinylidene fluoride resin.

11. A developer composition in accordance with claim 1 wherein the carrier consists of a steel core coated with a vinylidene fluoride resin.

12. A method of developing images which comprises forming a negative electrostatic latent image on an imaging member, contacting the image with a positively charged electrostatic developing composition comprised of toner particles and carrier particles, the toner particles being comprised of resin particles, pigment particles, and from about 0.1 percent to about 10 weight percent based on the weight of the toner particles of an alkyl pyridinium toluene sulfonate charge enhancing additive of the formula:

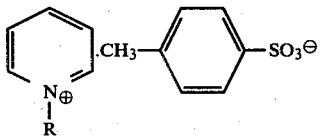

wherein R is an alkyl radical containing from about 12 carbon atoms to about 25 carbon atoms.

13. A method in accordance with claim 12 wherein R is an alkyl radical of from about 14 carbon atoms to about 20 carbon atoms, and the imaging member is an organic photoreceptor material.

14. A method in accordance with claim 12 wherein R is cetyl.

15. A method in accordance with claim 12 wherein the toner resin is a styrene/n-butylmethacrylate copolymer, or a styrene/butadiene copolymer, the pigment is carbon black, and the carrier is comprised of a steel core coated with a vinylidene fluoride resin.

16. A method in accordance with claim 12 wherein the charge enhancing additive is cetyl pyridinium para-toluene sulfonate.

17. A method in accordance with claim 12 wherein the charge enhancing additive is stearyl pyridinium para-toluene sulfonate.

18. A method in accordance with claim 12 wherein the charge enhancing additive is myristyl pyridinium para-toluene sulfonate.

19. A method of imaging in accordance with claim 13 wherein the organic photoreceptor material is comprised of a substrate, overcoated with a photogenerating layer, which in turn is overcoated with a charge transport layer.

20. A method of imaging in accordance with claim 19 wherein the photogenerating layer is comprised of metal free phthalocyanines, metal phthalocyanines, or vanadyl phthalocyanine.

* * * * *